US011965530B2

(12) United States Patent
Zhu et al.

(10) Patent No.: US 11,965,530 B2
(45) Date of Patent: Apr. 23, 2024

(54) EJECTOR WITH CORE NEEDLE COOLED BY COOLING MEDIUM

(71) Applicant: Tsinghua University, Beijing (CN)

(72) Inventors: Yinhai Zhu, Beijing (CN); Peixue Jiang, Beijing (CN)

(73) Assignee: Tsinghua University, Beijing (CN)

( * ) Notice: Subject to any disclaimer, the term of this patent is extended or adjusted under 35 U.S.C. 154(b) by 281 days.

(21) Appl. No.: 17/564,109

(22) Filed: Dec. 28, 2021

(65) Prior Publication Data

US 2022/0220982 A1 Jul. 14, 2022

(30) Foreign Application Priority Data

Jan. 8, 2021 (CN) ..... 202110021598.2

(51) Int. Cl.
*F04F 5/16* (2006.01)
*F04F 5/46* (2006.01)

(52) U.S. Cl.
CPC ..... *F04F 5/16* (2013.01); *F04F 5/461* (2013.01); *F04F 5/462* (2013.01)

(58) Field of Classification Search
CPC ..... F25B 9/08; F25B 2341/0014; F25B 2341/0016; F25B 2341/0013
See application file for complete search history.

(56) References Cited

U.S. PATENT DOCUMENTS

| | | | | |
|---|---|---|---|---|
| 10,704,813 | B2 * | 7/2020 | Lozyniak | F25B 9/08 |
| 10,928,101 | B2 * | 2/2021 | Chiappetta, Jr. | F25B 49/02 |
| 2005/0155374 | A1 * | 7/2005 | Oshitani | F25B 41/00 62/500 |

* cited by examiner

*Primary Examiner* — Lionel Nouketcha
(74) *Attorney, Agent, or Firm* — Patterson + Sheridan, LLP

(57) ABSTRACT

The present disclosure relates to the technical field of energy and power, in particular to an ejector with a core needle cooled by cooling medium. In the ejector with a core needle cooled by cooling medium, a cooling section is arranged between a stepping motor and a nozzle; the stepping motor, the cooling section and the nozzle are arranged coaxially, a partition plate and a sealing element are used to isolate the cooling medium from the primary flow medium, and the cooling medium is introduced into the cooling section to effectively cool the core needle therein, without affecting the adjustment function of the core needle for an area of the nozzle throat, so as to effectively improve the performance of the ejector. As the core needle is cooled, the adjustable ejector can be used in the primary flow fields with high temperature.

1 Claim, 1 Drawing Sheet

EJECTOR WITH CORE NEEDLE COOLED BY COOLING MEDIUM

CROSS-REFERENCE TO RELATED APPLICATIONS

This patent application claims the benefit and priority of Chinese Patent Application No. 202110021598.2 filed on Jan. 8, 2021, the disclosure of which is incorporated by reference herein in its entirety as part of the present application.

TECHNICAL FIELD

The present disclosure relates to the technical field of energy and power technology, in particular to an ejector with a core needle cooled by cooling medium.

BACKGROUND ART

An ejector has advantages of simple in structure, low in cost, easy to operate and convenient to maintain, thus is widely used in various fields such as refrigeration, fuel cells, chemical industry, aerospace and others. Depending on its use, an ejector is also called as jet vacuum pump, jet vacuum ejector, jet pump, water ejector, vacuum ejector or the like. As a pressurization, vacuum and mixing device, an ejector often plays a role of a key component in a system. Improving performance of the ejector can increase the overall system efficiency in the industrial fields to which the ejector relates.

The structure and size of an ejector affect its performance. In specific applications, operation parameters of a system often need to be changed, so the requirement for operation of the ejector under variable conditions is high. A common structural adjustment method for the ejector is to use a stepping motor to drive movement of the core needle so as to change the throat area of a nozzle. Due to the internal insulation performance requirement, the stepping motor needs to be controlled at a certain temperature (about 130 degrees). However, in some applications of the ejector, the temperature of the primary flow medium through the core needle will exceed said certain temperature, which will cause damage to the motor. Therefore, it is necessary to study cooling of the core needle and protection of the motor of the adjustable ejector.

SUMMARY

The purpose of the present disclosure is to provide an ejector with a core needle cooled by cooling medium, which uses the cooling medium to cool the core needle of the adjustable ejector without affecting adjustment function of the core needle for an area of a nozzle throat, thereby expanding a scope of use of the adjustable ejector.

The present disclosure proposes an ejector with a core needle cooled by cooling medium. The ejector includes a stepping motor, a cooling section, a nozzle, a secondary flow suction chamber and a core needle. The stepping motor, the cooling section, the nozzle and the secondary flow suction chamber are installed coaxially. A sealing element is arranged between the cooling section and the nozzle. The core needle is arranged along a central axis of the cooling section and the nozzle. The core needle passes through a central circular hole of the sealing element. An output shaft of the stepping motor is linked with the core needle. The nozzle is inserted into the secondary flow suction chamber. A cooling medium inlet and a cooling medium outlet are provided on the cooling section. An end of the nozzle close to the sealing element is provided with a primary flow medium inlet, a front end of the secondary flow suction chamber is provided with a secondary flow medium inlet, and a medium outlet is provided at an end outlet section of the ejector.

The ejector with the core needle cooled by the cooling medium, provided by the present disclosure, has the following advantages.

In the ejector with the core needle cooled by the cooling medium of the present disclosure, the cooling section is arranged between the stepping motor and the nozzle; the stepping motor, the cooling section and the nozzle are arranged coaxially, a partition plate and the sealing element are used to isolate the cooling medium from the primary flow medium; and the cooling medium is introduced into the cooling section to effectively cool the core needle within the cooling section, thereby preventing heat of the high-temperature core needle from being transferred to the stepping motor so as to protect the stepping motor. Meanwhile, the adjustment function of the core needle for the area of the nozzle throat is not affected; therefore, application range of the ejector with an adjustable nozzle throat area can be effectively expanded, especially suitable for the occasions where the temperature of the primary flow medium is high. The ejector with the core needle cooled by the cooling medium of the present disclosure is convenient to install, and has a simple structure and a small volume, etc.

LIST OF REFERENCE NUMERALS

1 stepping motor, 2 core needle, 3 sealing element, 4 nozzle, 5 secondary flow suction chamber, 6 mixing chamber, 7 diffuser, 8 cooling medium inlet, 9 cooling section, 10 cooling medium outlet, 11 primary flow medium inlet, 12 secondary flow medium inlet, 13 ejector outlet, 14 sealing ring, 15 output shaft.

DETAILED DESCRIPTION OF THE EMBODIMENTS

Figure 1:
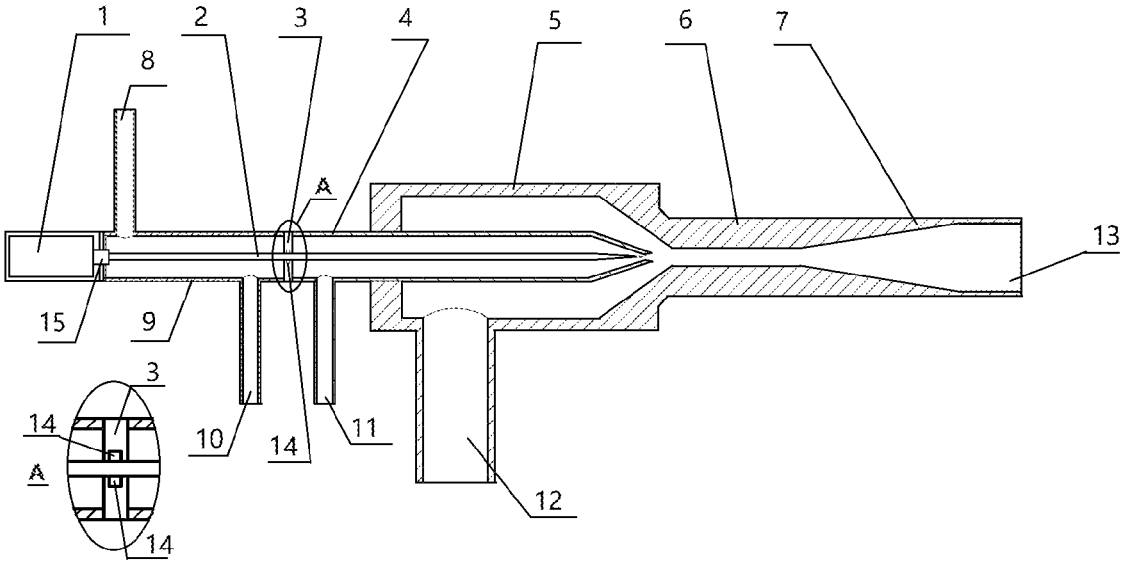
FIG. 1 is a schematic structural diagram of an ejector with a core needle cooled by cooling medium according to the present disclosure.

An ejector with a core needle cooled by cooling medium, provided by the present disclosure, is shown in FIG. 1. The ejector includes a stepping motor 1, a cooling section 9, a nozzle 4, a secondary flow suction chamber 5 and a core needle 2. The stepping motor 1, the cooling section 9, the nozzle 4 and the secondary flow suction chamber 5 are installed coaxially. A sealing element 3 is arranged between the cooling section 9 and the nozzle 4. The core needle 2 is arranged along a central axis of the cooling section 9 and the nozzle 4. The core needle 2 passes through a central circular hole of the sealing element 3. An output shaft 15 of the stepping motor 1 is linked with the core needle 2. The nozzle 4 is inserted into the secondary flow suction chamber 5. A cooling medium inlet 8 and a cooling medium outlet 10 are provided on the cooling section 9. An end of the nozzle 4 close to the sealing element 3 is provided with a primary flow medium inlet 11. A front end of the secondary flow suction chamber 5 is provided with a secondary flow medium inlet 12. An end of the diffuser 7 of the ejector is provided with a medium outlet.

The sealing element 3 in the ejector with the core needle cooled by cooling medium may be a connection sealing element. As shown in FIG. 1, the connection sealing element 3 is arranged between the cooling section 9 and the nozzle 4, and a sealing ring 14 is arranged around the central circular hole of the connection sealing element 3. The cooling section and the nozzle are mutually connected and fixed by the connection sealing element. During operation of the ejector, the connection sealing element is stationary, while the core needle 2 moves left and right, and the sealing ring 14 plays a sealing role when the core needle 2 moves.

Figure 2:
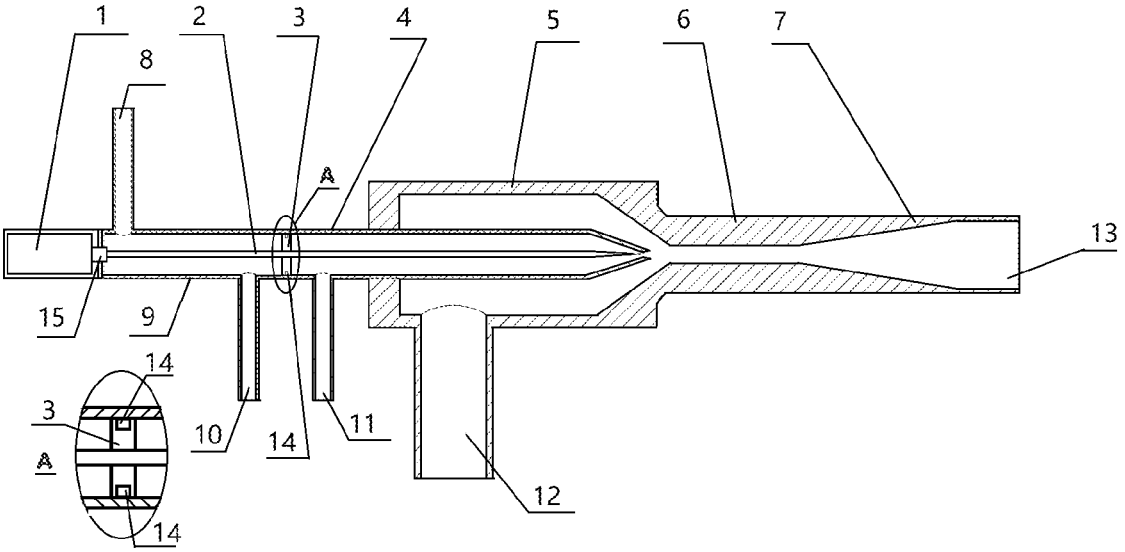
FIG. 2 is a schematic structural diagram of another ejector with the core needle cooled by cooling medium according to the present disclosure.

The sealing element 3 in the ejector 1 with the core needle cooled by cooling medium may also be a slidable sealing element, as shown in FIG. 2. An inner diameter of the cooling section 9 is equal to that of the nozzle 4, and the cooling section and the nozzle are fixed relative to each other. The slidable sealing element 3 is arranged within the cooling section and the nozzle. A sealing ring 14 is arranged in a concave cavity in an outer wall of the slidable sealing element. The core needle 2 is fixed relative to the slidable sealing element 3. During operation of the ejector, the slidable sealing element 3 moves left and right along with the core needle 2, as the core needle 2 moves left and right. The sealing ring 14 plays a sealing role when the slidable sealing element 3 moves.

The working principle and working process of the ejector with the core needle cooled by cooling medium in accordance with the present disclosure will be described in detail in combination with the accompanying drawings.

The ejector with the core needle cooled by cooling medium in accordance with the present disclosure includes: an ejector body which includes the nozzle 4, the secondary flow suction chamber 5, a mixing chamber 6 and the diffuser 7 etc.; an adjusting part which consists of the stepping motor 1 and the core needle 2; and a cooling system which includes the cooling section 9 and the slidable sealing element 3 etc. The cooling section 9 is arranged between the stepping motor 1 and the nozzle 4. The stepping motor 1, the cooling section 9 and the nozzle 4 are arranged coaxially.

The slidable sealing element 3 is arranged between the cooling section 9 and the nozzle 4, so that the slidable sealing element 3 is configured to isolate the cooling medium in the cooling section from the primary flow medium in the nozzle. A circular hole is opened in the center of the slidable sealing element 3, and the sealing ring 14 is arranged around the circular hole. The core needle 2 passes through the circular hole, and the sealing ring 14 plays a sealing role to prevent mutual leakage between the cooling medium in the cooling section and the primary flow medium in the nozzle.

During operation of the ejector with the core needle cooled by cooling medium in accordance with the present disclosure, the primary flow medium of the ejector flows in from the primary flow medium inlet 11, forms a supersonic flow at the outlet of the nozzle 4, and thus sucks a secondary flow in from the secondary flow inlet 12, and then the primary flow medium and the secondary flow medium are mixed in the mixing chamber 6. The mixed medium flows out of the ejector outlet 13 from the diffuser 7. The cooling medium flows in from the cooling medium inlet 8, cools the core needle and flows out of the cooling medium outlet 10.

The stepping motor 1 controls the core needle 2 to move left and right in a translation mode. The flow area of the primary flow medium in a throat of the nozzle is adjusted by a depth of the core needle 2 inserted into the throat of the nozzle, and then the flow rate of the primary flow medium is adjusted.

In one embodiment of the present disclosure, the cooling section 9 of the ejector is shaped like a circular sleeve, and the diameter of the cooling section 9 is equal to that of the nozzle 4.

In one embodiment of the present disclosure, air in an ambient environment can be used as the cooling medium.

In one embodiment of the present disclosure, a portion of the core needle in the cooling section 9 can be ribbed (not shown in the drawings) to increase the cooling effect of the cooling medium.

What is claimed is:

1. An ejector comprising:

a stepping motor installed coaxially with a cooling section, a nozzle, and a secondary flow suction chamber, the cooling section provided with a cooling medium inlet and a cooling medium outlet, wherein a sealing element is arranged between the cooling section and the nozzle, and the nozzle is inserted into the secondary flow suction chamber, and an end of the nozzle close to the sealing element is provided with a primary flow medium inlet, a core needle, arranged along a central axis of the cooling section and the nozzle, and cooled by a cooling medium, wherein the core needle passes through a central circular hole of the sealing element, and an output shaft of the stepping motor is linked with the core needle;

the nozzle configured to be inserted into the secondary flow suction chamber, wherein the secondary flow suction chamber is provided with a secondary flow medium inlet at a front end of the secondary flow suction chamber, and a medium outlet is provided at an end of the diffuser of the ejector;

wherein the sealing element is a connection sealing element arranged between the cooling section and the nozzle, and the connection sealing element comprises a first baffle with an outer periphery end fixed between the cooling section and the nozzle, an inner sealing ring connected to an inner periphery of the first baffle, wherein the inner ring is arranged around the central circular hole of the connection sealing element; and wherein the sealing element is a slidable sealing element, an inner diameter of the cooling section is equal to an inner diameter of the nozzle, the cooling section and the nozzle are fixed relative to each other; and the slidable sealing element is arranged within the cooling section and the nozzle, the slidable sealing element comprises a second baffle fixed to the core needle and an outer sealing ring arranged within a concave cavity in an outer wall of the slidable sealing element.

* * * * *